United States Patent [19]

Lohr et al.

[11] 4,023,804

[45] May 17, 1977

[54] SPHERICAL PROJECTILE GAME

[75] Inventors: Raymond J. Lohr; Richard N. Carver; James Ray, all of Erie, Pa.

[73] Assignee: Louis Marx & Co., Inc.

[22] Filed: Aug. 29, 1975

[21] Appl. No.: 609,114

[52] U.S. Cl. ..... 273/101; 273/95 D

[51] Int. Cl.[2] ..... A63B 65/12

[58] Field of Search ..... 273/39, 95 D, 101, 119 R, 273/119 A, 121 R, 121 A, 122 R, 122 A, 123 R, 123 A, 124 R, 124 A, 125 R, 125 A, 112

[56] References Cited

UNITED STATES PATENTS

| | | | |
|---|---|---|---|
| 1,279,637 | 9/1918 | Blackburn | 273/95 D |
| 1,531,880 | 3/1925 | Ritter | 273/95 D X |
| 1,653,545 | 12/1927 | Buedingen | 273/123 R |
| 1,933,406 | 10/1933 | Bardocz | 273/39 |
| 2,827,034 | 3/1958 | Rothe | 273/101 X |
| D171,736 | 3/1954 | Stach | 273/122 R X |

*Primary Examiner*—Anton O. Oechsle

*Attorney, Agent, or Firm*—Blum, Moscovitz, Friedman & Kaplan

[57] ABSTRACT

A game is provided which combines the elements of chance and coordinative skills. An elevated gaming surface is provided. Cooperatively mounted in the lowest end of the gaming surface is a game piece launcher. The game piece is a marble, steel ball or the like. The launcher includes a spring biased projector and a launch pad which is elevated and helical. On the upward end of the gaming surface are a plurality of annular concentric rings including scoring means for computing the score given to a launched game piece. Covering the gaming surface is a rigid transparent cover having an underside of predetermined configuration for cooperating with a projected ball and thereby guiding the projected ball in relation to the scoring indicia provided on the gaming surface. Tilting of the game surface causes return of the game piece or pieces to the starting position after computation of the score.

9 Claims, 7 Drawing Figures

SPHERICAL PROJECTILE GAME

BACKGROUND OF THE INVENTION

This invention relates to a novel game and more particularly to the type of game in which the game piece is projected toward a prearranged scoring means.

The instant invention is a sustained interest game combining the elements of chance and manipulative coordinative skills. One or more than one may play the game in sequence and the score of each player may be computed and updated at the end of each sequence of play. The coordinative aspect of the game involves the degree of acceleration given to the game piece on the projector means to obtain the highest game score, as described hereinafter in detail. The chance aspect of the game involves ricochets of the game piece against rigid playing surfaces.

After each score by a player, the game piece locates in one of a plurality of pockets serving as counters from which the score can be computed, and communicating with means for returning the game piece to its starting position.

SUMMARY OF THE INVENTION

Generally speaking, in accordance with the invention a game is provided which combines the elements of chance and coordinative skill. One end of a relatively planar gaming surface is elevated, for instance, on a pair of legs. Mounted in one end of the gaming surface is a game piece launching means including a cooperative spring biased projector and a helically elevated launch pad.

The game piece is a marble, steel ball or the like. The elevated, helical arrangement of the launch pad has defined therein a spiral channel through which the game piece accelerates according to the momentum imparted thereto by the spring biased projector. The sprial path in the launch pad comes to an abrupt upwardly inclined end for the purpose of elevating the projected arc of the game piece as it projects from the launch pad.

Diametrically arranged on the gaming surface relative to the launch means are a plurality of concentric annular rings of decreasing diameter. Each annular ring circumscribes an area having a given point value, the area defined by the annular ring having the least diameter concomitantly having the highest point value. The object of the game is to project the game piece in such a way that the highest point value is accumulated.

Each circular area is provided with means for returning the game piece to a discrete counting channel which may be used to compute a score. The game is adapted, therefore, for a plurality of consecutively employed game pieces.

Associated with each discrete counting channel is a means for returning a game piece to its initial starting position. Covering the gaming surface is a rigid transparent cover including a dome portion having an underside of concave configuration for rebounding a projected game piece in relation to the scoring indicia provided on the gaming surface.

Accordingly, it is an object of the present invention to provide a novel game combining the elements of chance and coordinative skill.

Another object of the invention is to provide a game with sustained attention value.

Still another object of the invention is to provide a game which does not require complex rules to be memorized.

A further object of the invention is to provide a game that may be played by any number of players.

Still other objects and advantages of the invention will in part be obvious and will in part be apparent from the specification.

The invention accordingly comprises the features of construction, combinations of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 3:
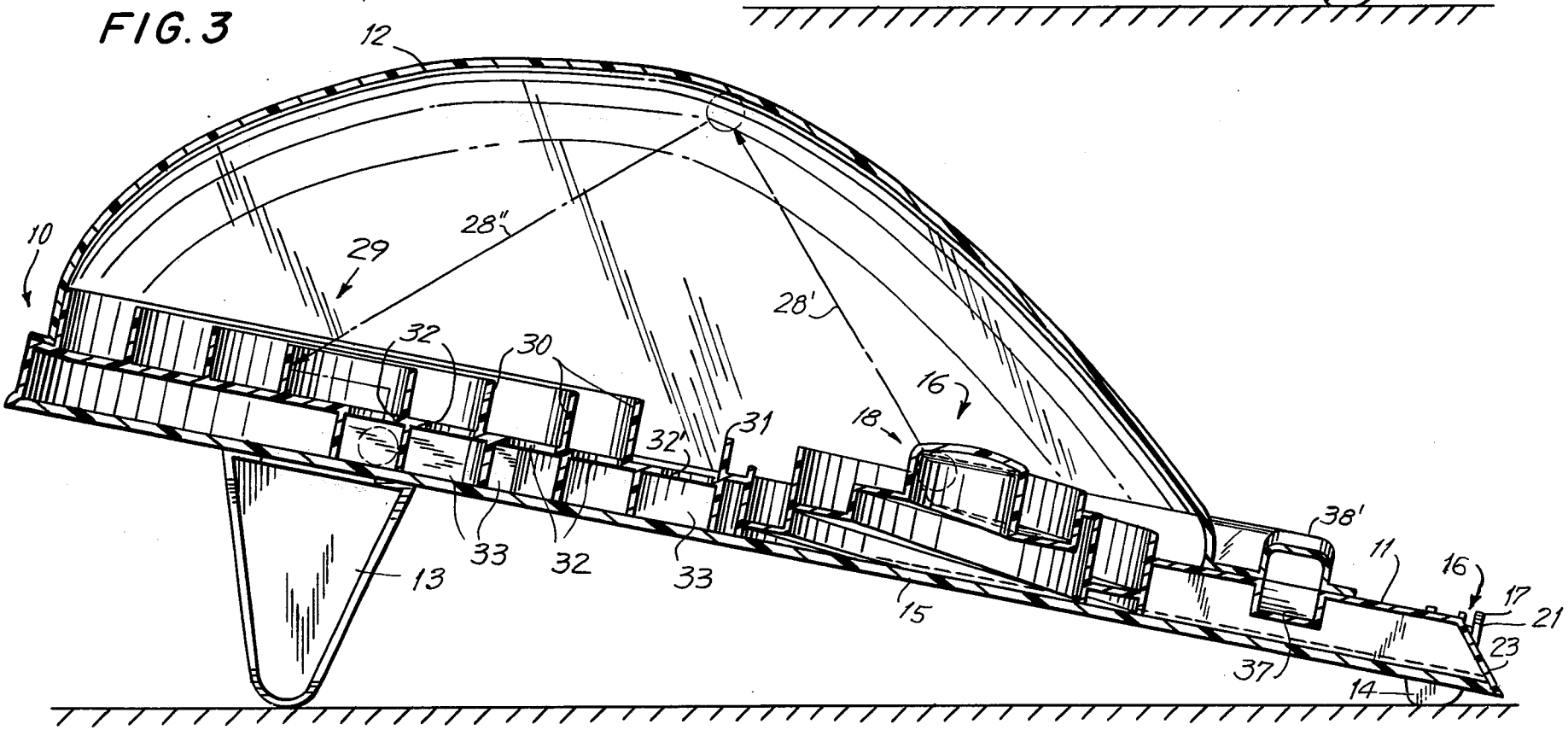
FIG. 3 is a sectional view taken along line 3—3 of FIG. 2.

Referring now to the Figures, a substantially planar game board 10 has a playing surface 11 which is partially housed under a rigid transparent dome 12. With reference to the view seen in FIG. 1, the far end of game board 10 is elevated on a pair of corresponding laterally spaced legs 13 and 13' while the near end of the game board is provided with a pair of corresponding support pads 14 and 14' as best seen in FIG. 3. Therefore, in its operative position, game board 10 is inclined.

Figure 1:
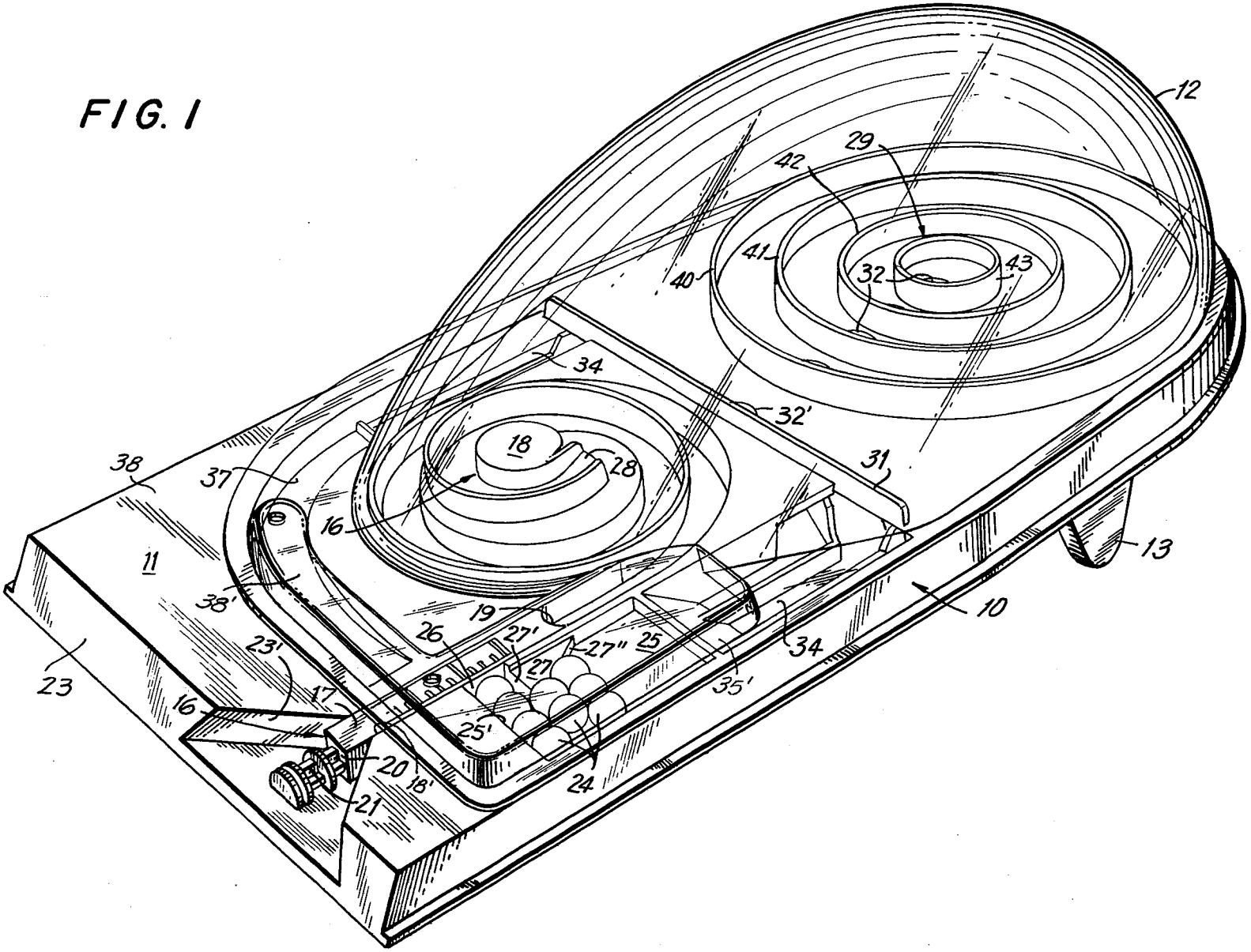
FIG. 1 is a perspective view of a game constructed in accordance with the invention.
Figure 2:
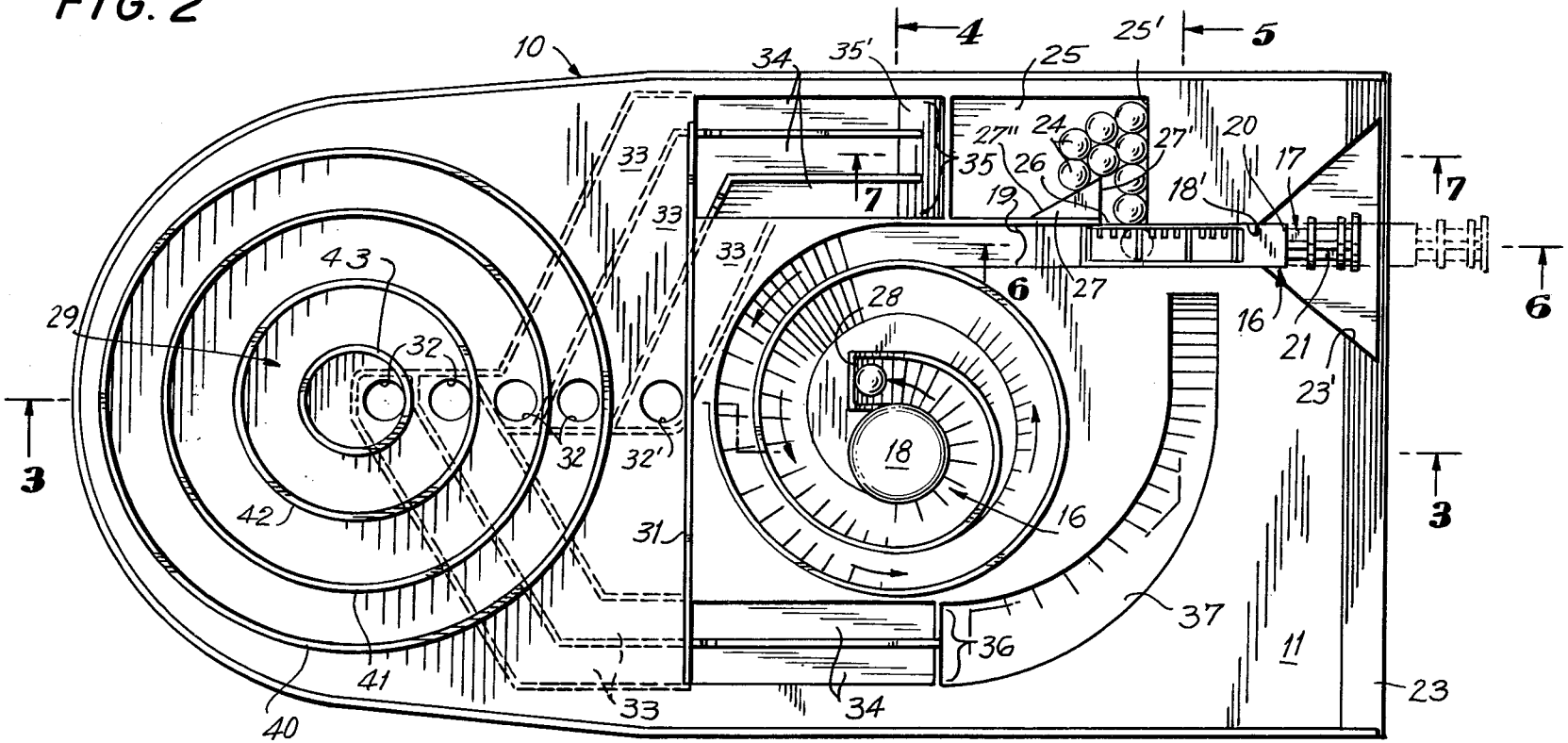
FIG. 2 is a top plan view of the embodiment seen in FIG. 1.
Figure 5:
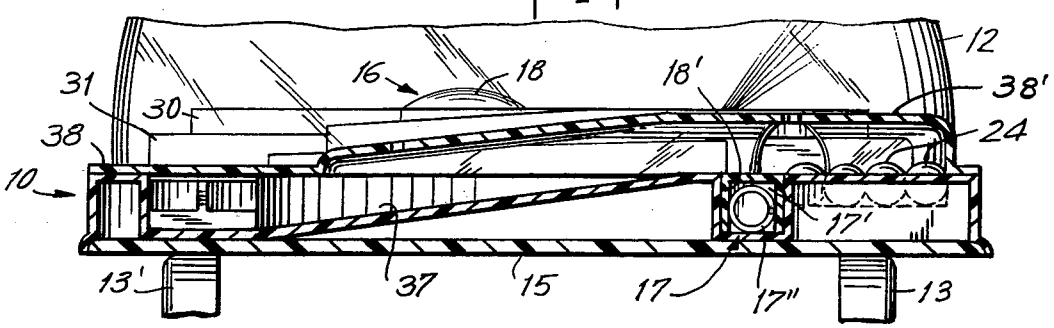
FIG. 5 is a sectional view taken along line 5—5 of FIG. 2.
Figure 7:
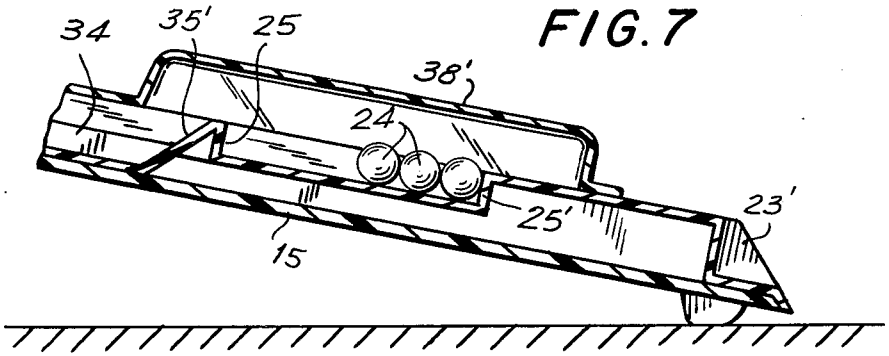
FIG. 7 is a sectional view taken along line 7—7 of FIG. 2.
Figure 6:
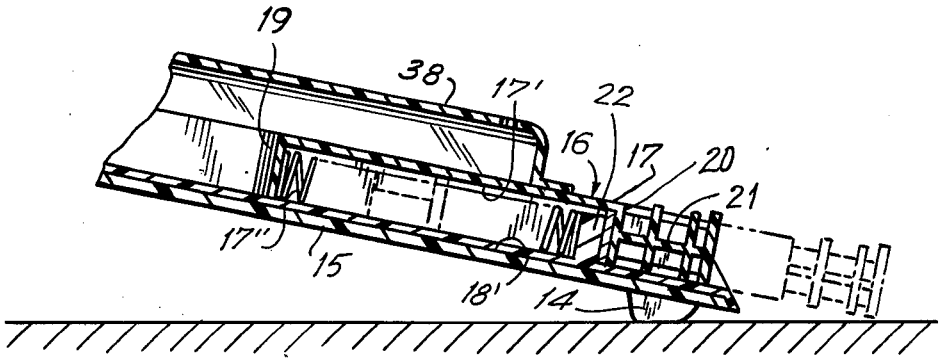
FIG. 6 is a sectional view taken along line 6—6 of FIG. 2; annd

Mounted at the lower portion of playing surface 11, as viewed when the game is in playing position, for instance as seen in FIG. 1, is a means 16 which includes s spring biased projector 17 and a helically wound elevating spiral path 18 associated therewith as best seen in FIGS. 1, 2 and 6. Projector 17 is slidably mounted in a channel 18' on an inset portion 23' of end wall 23 of game board 10 which communicates with elevating spiral path 18. Mounted in end 20 of projector 17 is a finger piece 21. Interiorly mounted in projector 17 within a slot 17' therein is a compression spring 17''. As best seen in FIG. 6, one end of compression spring 17'' is mounted against an interior end wall 19 of projector 17, the other end of compression spring 17'' is mounted against a fixed lug 22 mounted on the game board and upstanding into slot 17'. The bias arrangement provides a reciprocable mounting for means 16.

A plurality of marbles 24 are contained by a pocket 25 in playing surface 11 which is contiguous to means 16. Pocket 25 communicates with channel 18' through an aperture 26, however, access into channel 18' from pocket 25 is controlled by the position of means 16 in channel 18'. When projector 17 is withdrawn past aperture 26, for instance by exerting longitudinal manual pressure on finger piece 21, a marble 24 may enter channel 18′ through aperture 26 in pocket 25. Upon entry into channel 18′ the marble 24 abuts against the front wall of projector 17.

Aperture 26 in pocket 25 is formed between end wall 25′ of pocket 25 and an elbow 27 mounted therein. Elbow 27 includes a side wall 27′ substantially parallel to end wall 25′ and a wall 27″ arranged diagonally therewith. The distance between walls 25′ and 27′ is substantially equal to the diameter of marble 24. Therefore, marbles 24 are held in alignment within an acces channel to aperture 26 in pocket 25 formed between walls 25′ and 27′, respectively.

Upon releasing a longitudinally directed pressure on finger piece 21, the bias thereon returns it to its normal position and a marble 24 within channel 18′ is accelerated out of channel 18′ into helically wound elevating spiral path 18. The end 28 of path 18 is upwardly inclined for projecting marble 24 through a predetermined arc at the end of path 18 according to the velocity thereof as it leaves end 28 of path 18. Diametrically opposite end 28 of path 18 on playing surface 11 is a scoring area 29 for awarding points to a player based upon the final position of the marble 24 after its projection.

Scoring area 29 includes a plurality of concentric annular members 40, 41, 42 and 43 of decreasing diameter. Each annular member defines a circular area with its corresponding outermost next annular member on playing surface 11, except, of course, for annular member 43 which is of smallest diameter and which itself defines a circular area having a point total associated therewith. The most difficult location to land a projected game piece in, viz., the area determined by annular member 43, corresponds to the highest point score. As the diameters of concentric members 40, 41, 42 and 43 respectively increases, the point totals applied to the corresponding circular areas determined thereby decreases. At its interior end on playing surface 11, scoring area 29 is provided with a flange 31 arranged widthwise across playing surface 11. Therefore, a marble 24 which does not locate within the members 40, 41, 42 and 43 is restrained from leaving the scoring area 29 by flange 31 thereof.

Each circular area determined between a pair of concentric members 40, 41, 42 and 43 includes a marble return slot 32. Each return slot 32 is provided in playing surface 11 at a point corresponding to the lowest point of respectively concentric annular members 40, 41, 42 and 43. As thus arranged in playing surface 11, return slots 32 are aligned, as best seen in FIG. 2. A return slot 32′ is also provided in playing surface 11 contiguous with flange 31 in substantial alignment with slots 32 for the purpose of providing access to the score counting means for a marble 24 restrained by flange 31.

Referring particularly to FIGS. 2 and 3, return slots 32 and slot 32′ communicate with respective discrete channels 33 which are interiorly arranged in game board 10 so as to be unobservable from the exterior of game board 10. Each return slot 32 and 32′ communicates with a respective channel 33. Each channel 33 in turn communicates with a corresponding pocket 34. Depending upon the number of game pieces located in a given pocket 34 at the end of a round of play, the user's score may be easily tallied since each pocket 34 is associated with a particular section of the scoring area. In the preferred embodiment, the pockets 34 are clustered into a group of three at one side of the board and a group of two at the other side of the board. Associated with each cluster of pockets 34 is a means for returning marbles 24 therein to their starting position in pocket 25. For instance, the cluster of three pockets 34 which has been designated by numeral 35 is contiguously arranged relative to pocket 25. Therefore, by providing the cluster 35 of pockets 34 with an inclined end wall 35′, marbles 24 within cluster 35 may be positively guided into game piece pocket 25 by manually tilting game board 10 to a suitable angle of inclination.

Concomitantly, the cluster of two pockets 34 is generally designated by numeral 36. Contiguously arranged relative to the end of pocket cluster 36 is a sloped, arcuate channel 37. As best seen in FIGS. 1 and 2, a marble in either pocket of cluster 36 at the end of a round of play may be dropped over the rear wall of the pockets 34 in cluster 36 into the entrance way of channel 37. In channel 37, the marble 24 picks up sufficient momentum to accelerate up the inclined end thereof and over the surface of game board 10 toward the vicinity of pocket 25. The marble may then be located in pocket 25 by tilting game board 10.

Laterally extending from the perimeter of dome 12 is a transparent protective covering 38 overlying the remainder of playing surface 11. A recessed enclosed canopy 38′ is provided in covering 38 which includes a body section covering pocket 25, an area of playing surface 11 in the immediate vicinity therof and partially covering cluster 35 of pockets 34. Canopy 38′ also includes a neck portion which provides a partial covering for channel 37. Canopy 38′ provides means for positively guiding marbles 24 back into pocket 25, without undue attention being given to the angle of elevation given to game board 10 for returning the game pieces to pocket 25 prior to the start of a new round of play.

Figure 4:
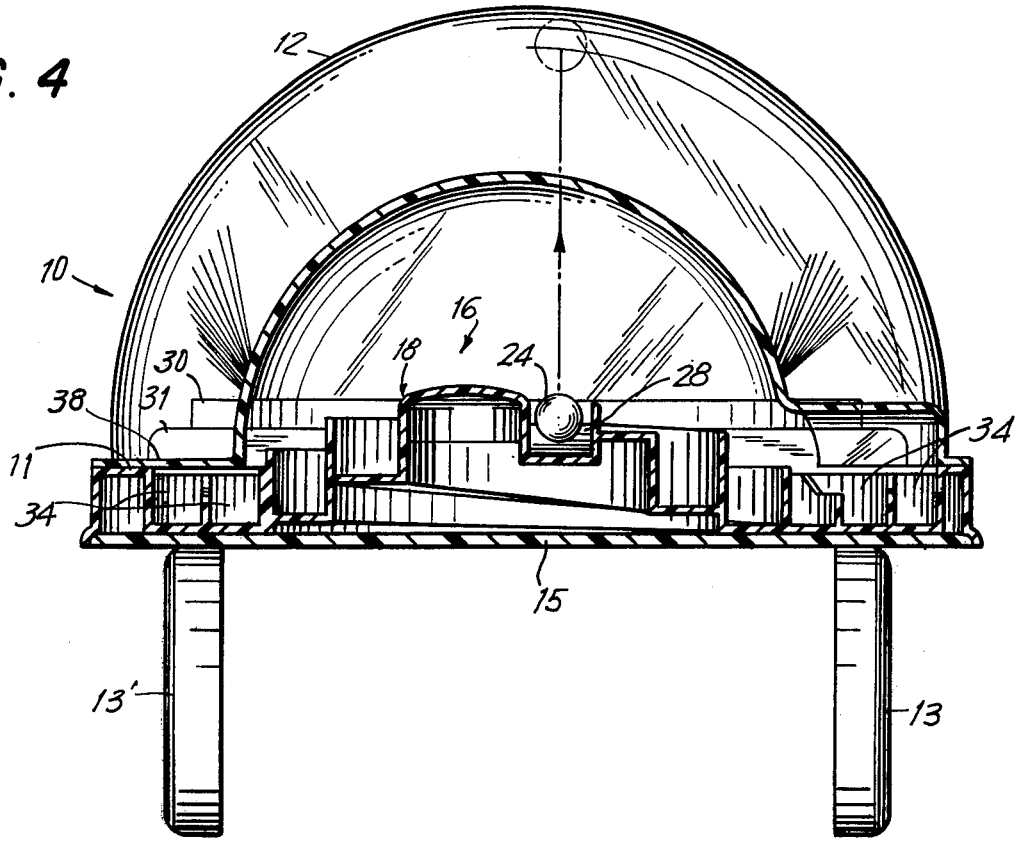
FIG. 4 is a sectional view taken along line 4—4 of FIG. 2.

As best seen in FIGS. 1 and 3, rigid transparent dome 12 overfits elevating spiral path 18 and scoring area 29 on playing surface 11. As best seen in FIGS. 3 and 4, dome 12 has a predetermined contoured configuration so as to provide positive guidance for a marble 24 projected from the end 28 of spiral path 18. Upon leaving end 28 of spiral path 18, marble 24 follows a trajectory 28′ which impinges against the interior surface of dome 12 and is angled acutely downwardly toward scoring area 29 along trajectory 28″. The displacement angle of marble 24 after impingement against dome 12 is dependent upon the curvature of dome 12 at the point of contact. At lower and higher velocities, the marble will have a trajectory 28′ which impinges against a different point on the interior of dome 12 and the downward trajectory 28″ thereof into scoring area 29 corresponds to the change therein. Therefore, dome 12 additionally provides means for containing the play action of the game within the area of playing surface 11.

As is apparent from the above description, when a spherical projectile or game piece 24 reaches the end 28 of the elevated helical spiral path 18, the game piece 24 will not only be projected toward the scoring area 29, but in addition, as the game piece travels toward the scoring area 29, it will not necessarily travel precisely perpendicularly across the flange 31 but instead may possibly also travel along a trajectory inclined toward the left or right of the central portion of the scoring area 29, depending upon the manner in which the projectile travels up the path 18. Since the substantially rigid dome 12 has a downwardly directed concave surface, it is clear that either the point of this concave surface which is engaged by the projectile will be unpredictable for a given player or a considerable amount of skill will be required for a player to approximate even closely a preselected area of the lower concave surface of the dome 12 to be engaged by a projectile. Because of the concave configuration of the inner surface of the dome 12, the projectile is rebounded from this surface not only downwardly but also laterally, depending upon the travel of the projectile toward the inner concave surface of the dome 12, so that the trajectory taken by the projectile is relatively complex, thus heightening the elements both of chance and skill involved in the game of the invention.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. A gaming device comprising, in combination, a substantially planar game board having a playing surface, means for elevating an end of said playing surface relative to an opposed end thereof so as to incline said playing surface, a spherical game piece, means mounted at said opposed end of said playing surface for launching said game piece through a trajectory, a scoring area mounted on said elevated end of said playing surface onto which said game piece is projected, and a rigid transparent dome overfitting said launching means and said scoring area, and said transparent dome having an inner concave surface directed downwardly toward said scoring area and against which said game piece is adapted to strike for rebounding angularly from said concave surface toward said scoring area, said launching means including a projector and a helically wound elevating spiral path associated therewith for receiving a game piece therefrom and for increasing the elevation of the game piece while directing the same along a helical path, said path terminating in an edge from which the game piece travels freely upwardly toward said concave surface from which it is rebounded toward a central portion of said scoring area or various longitudinal and lateral distances therefrom depending upon the force with which the game piece is projected by said projector and the lateral angle it leaves the edge, respectively.

2. The gaming device as claimed in claim 1 wherein said projector is spring biased and adapted to accelerate said game piece along said spiral path.

3. The gaming device as claimed in claim 2, said projector including a rigid member slidably mounted in a channel communicating with said spiral path, said rigid member having an interior slot, a compression spring mounted in said slot, said compression spring having a first end mounted against said rigid member and a second end mounted against a stationary point on said game board, and a finger piece mounted on said rigid member.

4. The gaming device as claimed in claim 3 including a pocket contiguous to said rigid member in said playing surface, said pocket normally providing a container for said game piece, said pocket having an access port into said channel in which said rigid member is slidably mounted so as to permit a deposit of said game piece into said channel, access into said channel through said access port being controlled by the position of said rigid member in said channel, said rigid member being positionable by exerting manual pressure on said finger piece and having a normal first position preventing access into said channel through said access port and a second withdrawn biased position for access of said game piece into said channel through said access port.

5. The gaming device as claimed in claim 4 including means mounted in said game piece pocket for aligning one game piece at a time before said access port.

6. The gaming device as claimed in claim 1, said scoring area including a plurality of concentric annular members of decreasing diameter, each annular member defining a circular area on said playing surface, and a corresponding plurality of game piece return slots provided in said playing surface, one of said plurality of return slots being interiorly adjacent each annular member.

7. The gaming device as claimed in claim 6 including a corresponding plurality of discrete channels, each of said channels communicating with a return slot, said channels being interiorly arranged in said game board so as to be unobservable from the exterior of said game board, and a corresponding plurality of score keeping pockets, each of said score keeping pockets communicating with a channel, a projected game piece being delivered to one of said score keeping pockets through one of said return slots and its associated channel in said scoring area of said game board.

8. The gaming device as claimed in claim 7 incluidng means in said playing surface for delivering a played game piece from a score keeping pocket to a game piece pocket.

9. The gaming device as claimed in claim 8 including a canopy partially overfitting said game piece return means so as to permit manipulation of said game board without loss of said game piece.

* * * * *